US005553772A

United States Patent [19]

Jensen

[11] Patent Number: 5,553,772

[45] Date of Patent: Sep. 10, 1996

[54] PAPERBOARD CLAMSHELL CARTON

[75] Inventor: Kurt D. Jensen, Newburgh, N.Y.

[73] Assignee: International Paper, Purchase, N.Y.

[21] Appl. No.: 558,565

[22] Filed: Oct. 31, 1995

[51] Int. Cl.[6] ..... B65D 5/22

[52] U.S. Cl. ..... 229/148; 229/114; 229/116.1; 229/906

[58] Field of Search ..... 229/106, 107, 229/114, 116.1, 146, 148, 149, 902, 906

[56] References Cited

U.S. PATENT DOCUMENTS

| | | | |
|---|---|---|---|
| D. 100,178 | 6/1936 | Shields . | |
| D. 165,861 | 2/1952 | Paige . | |
| D. 202,449 | 9/1965 | Braun . | |
| D. 264,687 | 6/1982 | Austin . | |
| D. 309,105 | 7/1990 | Fisher . | |
| D. 320,743 | 10/1991 | Alexander . | |
| D. 321,324 | 11/1991 | Budzbanowski . | |
| 3,010,571 | 11/1961 | Transport . | |
| 3,078,989 | 2/1963 | Curran . | |
| 3,343,660 | 9/1967 | Bailey . | |
| 3,511,433 | 5/1970 | Andrews . | |
| 4,930,681 | 6/1990 | Fultz et al. | 229/148 |
| 4,951,865 | 8/1990 | Eisman | 229/114 |
| 5,039,003 | 8/1991 | Gordon et al. | 229/114 |
| 5,188,284 | 2/1993 | Eisman | 229/114 |
| 5,205,476 | 4/1993 | Sorenson | 229/114 |
| 5,332,147 | 7/1994 | Sorenson | 229/114 |
| 5,388,758 | 2/1995 | Scovell | 229/114 |
| 5,431,333 | 7/1995 | Lorenz | 229/906 |

FOREIGN PATENT DOCUMENTS

| | | | |
|---|---|---|---|
| 2410 | of 1914 | United Kingdom | 229/116.1 |
| 773138 | 4/1957 | United Kingdom | 229/116.1 |

*Primary Examiner*—Gary E. Elkins
*Attorney, Agent, or Firm*—Michael J. Doyle

[57] ABSTRACT

A clamshell type container is formed from a unitary blank of paperboard. The central portion of the crown of the carton is convex upwardly and the crown carries inwardly concave opposite side walls. The four corners of the crown are each provided with triangular gussets to permit slight deformation of the crown both upon stacking of the open cartons and upon closing the crown down onto the lower tray part of the carton. The tray side walls are curved or recessed downwardly so as to form line contact with a respective crown side wall, such contact defining a seal and inhibiting warm air loss when a warm foodstuff is placed in the carton.

6 Claims, 3 Drawing Sheets

PAPERBOARD CLAMSHELL CARTON

BACKGROUND OF THE INVENTION

This invention relates to a clamshell type container or carton formed from a unitary blank of paperboard. Such cartons are characterized by a top lid or closure, often termed a crown, and a lower tray. The crown and tray have a common rear horizontal hinge joining their respective rear walls, with the tray having upwardly extending side walls, a front wall, and a rear wall. The crown has downwardly depending side walls, a front wall, and a rear wall. The crown is releasably latched to a closed position covering the tray by interengaging tongues or latches carried by the tray and crown. By virtue of the inherent resilience of paperboard, the tongues are easily engaged and disengaged. Typically, a warm fast food item such as a hamburger is placed into the tray and the crown closed for serving to a consumer.

While such cartons have met wide acceptance, there still is a need to improve their heat retention capability, as well as to improve their flexibility to permit easier stacking and easier conformation of the crown relative to the tray in the carton closed configuration.

SUMMARY OF THE INVENTION

According to the practice of this invention, the crown of a clamshell type carton fashioned from a unitary blank of paperboard is provided with concave sides whose lower edges extend downwardly beyond the upper edges of the tray side walls. In turn, the upper or free edges of the tray side walls are recessed so as to be concave. A portion of the inner surfaces of the lower interior crown side walls thus abuts and conforms to the curvature of the recesses of the free edges of the tray side walls. This abutting forms a kind of seal to maintain heat within the interior of the closed carton. Further, the four corners of the crown are provided with triangular gussets which permit the crown to adjust its form slightly when it is folded down to close the carton, thus compensating for any irregularities in the shape of the tray by permitting the crown walls to deform slightly.

DETAILED DESCRIPTION OF THE INVENTION

Figure 1:
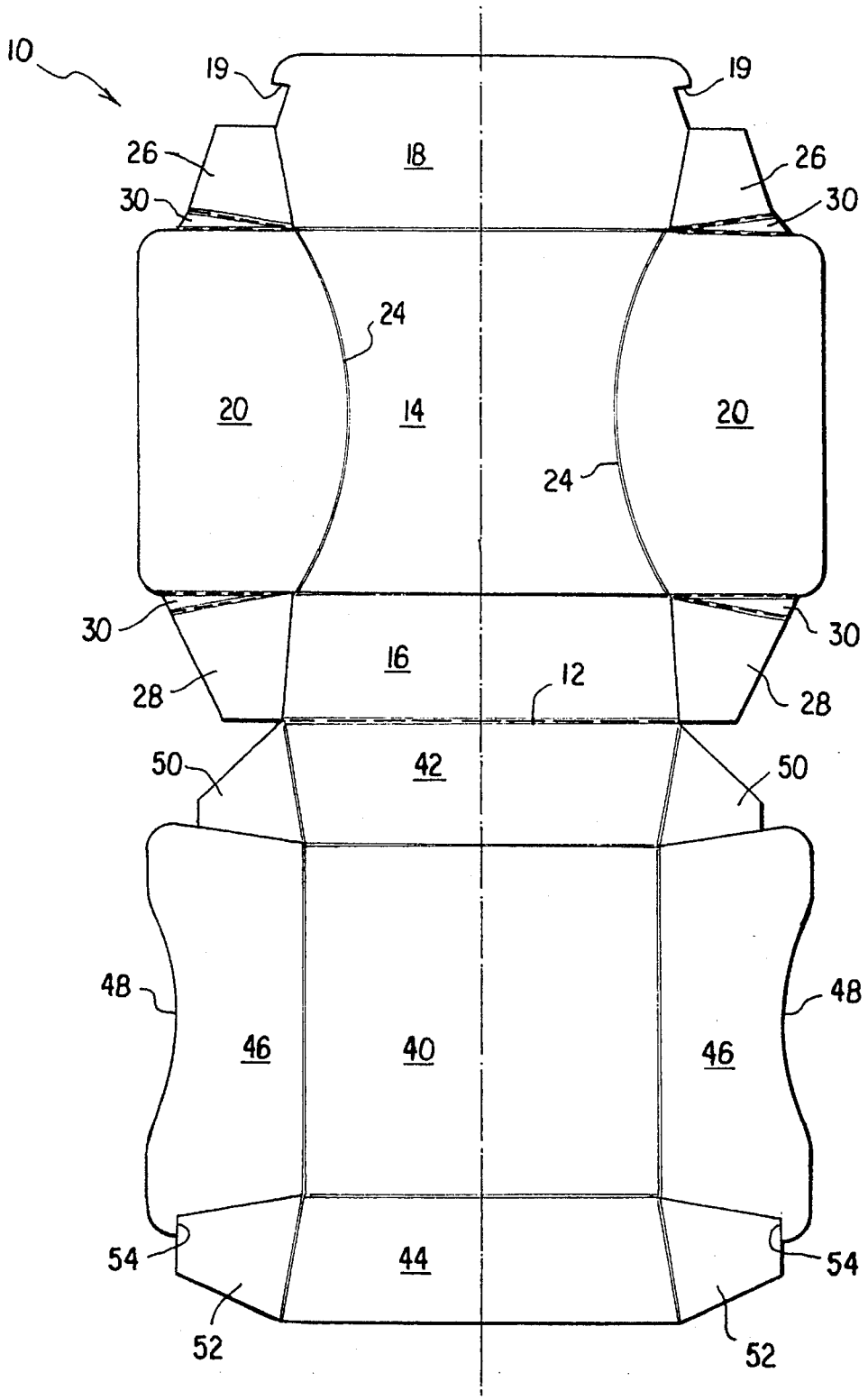
FIG. 1 is a plan view of a unitary paperboard blank from which the carton of this invention is fashioned.

At FIG. 1 the unitary tray blank of paperboard is denoted as 10 and exhibits the indicated longitudinal axis of mirror symmetry. The upper or crown forming portion of the blank includes horizontal fold line 12, top panel 14, rear wall panel 16, front wall panel 18 with lateral latching tongues 19, and side walls 20. The side walls are joined to top panel 14 by inwardly concave fold lines 24. Glue flaps 26 and 28 are joined by triangular gusset panels 30, having the indicated intersecting fold lines, to respective side walls 20.

The blank tray portion is defined by bottom panel 40, rear wall panel 42, front panel 44, and side panels 46, each of the latter having a concave recess 48 centered along its free edge. Glue flaps 50 and 52 are foldably secured, respectively, to panels 42 and 44. Tray latches or tongues are denoted as 54.

In the drawing of FIG. 1, the fold lines of the blank are denoted by double lines, while cut lines are denoted by single lines.

Figure 2:
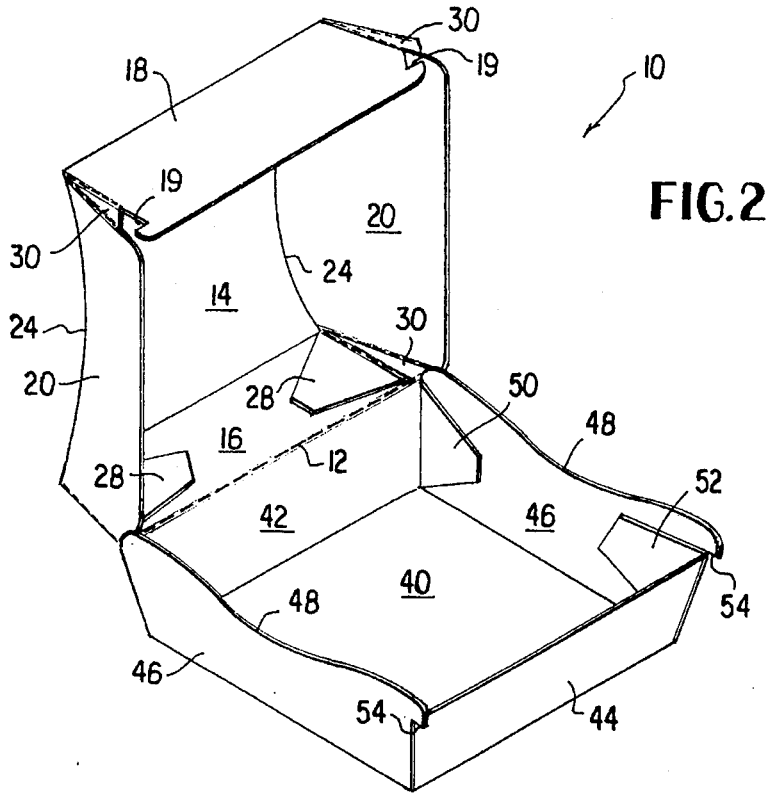
FIG. 2 is a perspective view of the carton in its open configuration.
Figure 3:
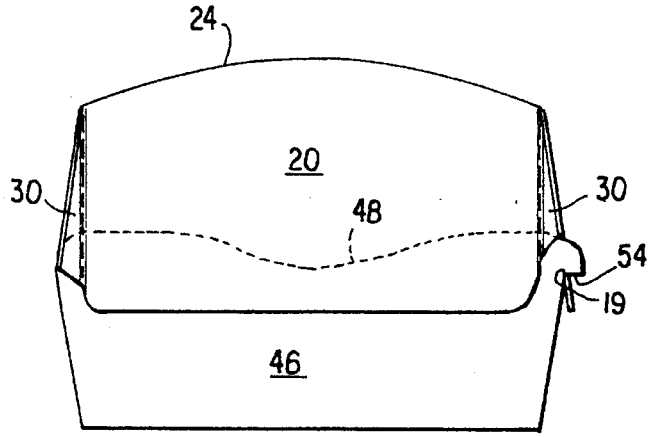
FIG. 3 is a side elevational view of the closed carton.

At FIG. 2, the blank has been folded and the glue flaps glued to respective tray side walls and crown front and rear walls to thus form the carton. Glue is not applied to crown gussets 30 however. It is seen that triangular gussets 30 are located at lateral ends of crown side walls or panels 20.

Figure 4:
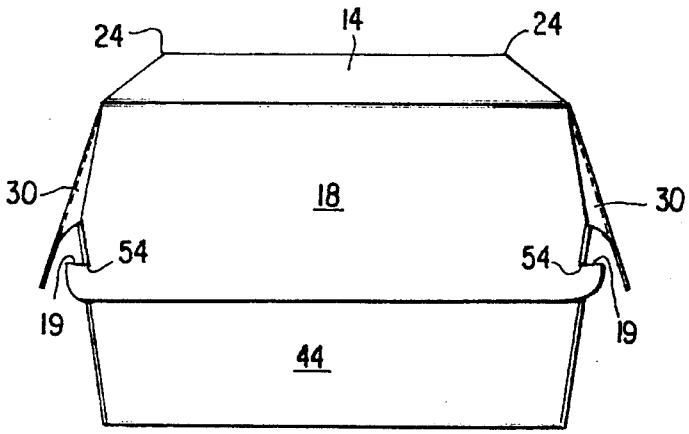
FIG. 4 is a front elevational view of the closed carton.
Figure 5:
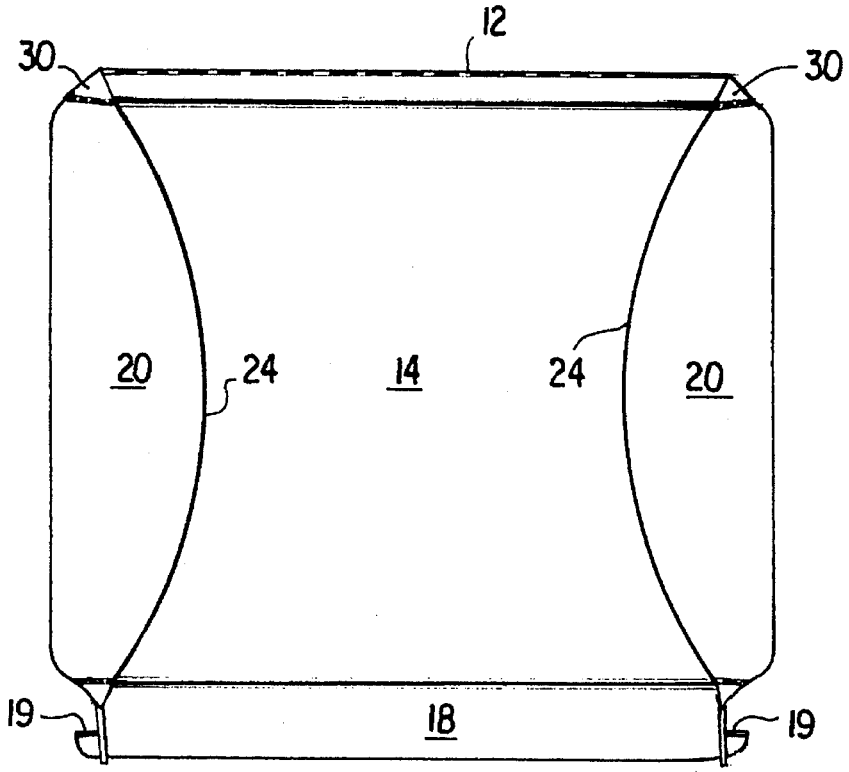
FIG. 5 is a top plan view of the closed carton.
Figure 6:
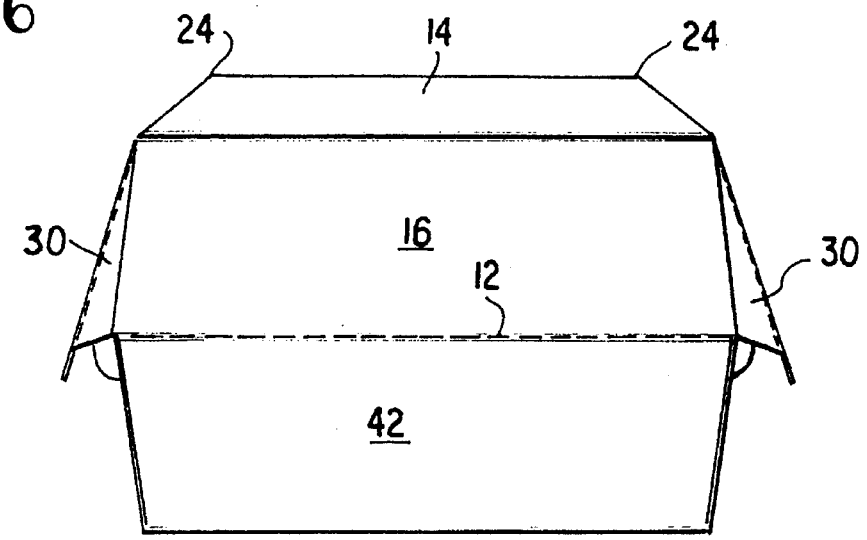
FIG. 6 is a rear elevational view of the closed carton.

The configuration of the closed carton is shown in the several views of FIGS. 3 to 6 where, for example, the latching action of tongues 19 and 54 may be seen. In closing the carton from the FIG. 2 configuration, tongues 19 and 54 deform as they pass each other to the latched position. These tongues are then manually deformed to unlatch the carton. As viewed from the side, FIG. 3, it is seen that the crown top is convex upwardly from the crown rear panel to the crown front panel, this convex surface being a portion of an imaginary right cylinder having a longitudinal axis normal to the plane of FIG. 3. This upward convexity permits a greater matching or correspondence between the interior of the top part of the crown and a the top bun of hamburger or other sandwich placed within the carton. Further, this convexity strengthens the vertical crush or deformation resistance of the crown, in the event several of the filled cartons are vertically stacked as in a paper bag when presented to the consumer. FIGS. 4 and 6 illustrate that the lowest portions or free edges of crown side walls 20 extend beneath the curved free edges of tray side walls 46. Similarly, the lowest or free edge portion of crown front panel 18 extends beneath the upper or free edge of tray front panel 44. FIG. 5 also illustrates concave fold lines 24 which join the upper portions of side panels 20 to top crown panel 14. Such curvature of fold lines 24 imparts a concave shape to opposite crown side walls 20. The inward slope of the crown side walls sometimes contacts portions of the upper bun of the sandwich, depending on the size of the bun, to thereby help retain the sandwich in the center of the carton. Further, this inward sloping reduces the volume of air between the interior surfaces of the crown and a sandwich placed within the carton, thus reducing the rate of cooling of the sandwich.

The curvature or degree of concavity of tray side wall recesses 48 and the concavity of crown side walls 20 is such that when the carton is closed there is substantial continuous line contact between respective free, curved edges 48 and respective interior surfaces of crown side walls 20. Such line contact forms a seal to inhibit loss of warm air from the carton interior and entry of cool air when the carton is loaded with a warm hamburger or other food item. As well as permitting the crown side, front, and rear walls to deform slightly and more readily upon carton closure, triangular gussets 30 at the crown corners permit a similar crown deformation upon stacking of the glued but open cartons.

I claim:

1. A one piece clamshell carton having a bottom tray including a bottom panel, two upstanding side panels, a rear panel and a front panel, said carton also having a crown including a top panel, two side panels, a rear panel and a front panel, said tray and crown rear panels being foldably joined about a common rear horizontal axis, said crown side walls being concave towards each other, said crown being swingable about said rear horizontal axis to close said tray, a portion of respective said side panels of said crown extending downwardly beyond a portion of respective said tray side panels,,said crown side panels located outwardly of said tray side panels, said crown front wall located outwardly of said tray front wall, a lowest portion of said crown front wall extending downwardly relative to a portion of said tray front wall.

2. The carton of claim 1 wherein said tray side panels each have a free edge, each free edge being concavely curved, whereby said concave side panels of said crown substantially contact respective said tray side panel curved free edges, along respective curved lines, to thereby assist in retaining beat in the carton when a hot food product is placed in the carton and said carton is closed.

3. The carton of claim 2 including means carried by said carton top to releasably latch said crown to said tray.

4. The carton of claim 1 wherein said crown top panel is convexly upwardly curved so as to define a part cylindrical surface.

5. The carton of claim 4 wherein said crown side panels have upper edges which are joined along concave fold lines to respective opposite edges of said crown top panel.

6. The carton of claim 1 wherein said crown has four corners, each corner having a triangular gusset panel to thereby permit said crown to more readily deform from a normal configuration.

* * * * *